US009427136B2

(12) United States Patent
Kent

(10) Patent No.: US 9,427,136 B2
(45) Date of Patent: Aug. 30, 2016

(54) COLLAPSIBLE DISH DRAINER

(71) Applicant: Progressive International Corporation, Kent, WA (US)

(72) Inventor: Joseph Kent, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 0 days.

(21) Appl. No.: 14/692,969

(22) Filed: Apr. 22, 2015

(65) Prior Publication Data

US 2015/0297058 A1 Oct. 22, 2015

Related U.S. Application Data

(60) Provisional application No. 61/982,639, filed on Apr. 22, 2014.

(51) Int. Cl.
*A47L 19/04* (2006.01)

(52) U.S. Cl.
CPC ..... *A47L 19/04* (2013.01)

(58) Field of Classification Search
CPC ..... A47L 19/00; A47L 19/02; A47L 19/04; A47L 15/50; A47L 15/503
USPC ..... 211/41.6
See application file for complete search history.

(56) References Cited

U.S. PATENT DOCUMENTS 1,270,631 A * 6/1918 Lewis ..... A47L 19/04 220/23.4
1,487,942 A * 3/1924 Hines ..... A47L 19/04 211/41.3
1,643,905 A * 9/1927 Rossner ..... A47L 19/02 220/212
1,669,284 A 5/1928 Chetham
1,675,855 A 7/1928 Kogler et al.
1,679,594 A * 8/1928 Andrews ..... A47L 19/00 220/487
1,789,232 A * 1/1931 Hertz ..... A47L 19/04 211/41.3
1,908,128 A * 5/1933 De Bie ..... A47L 19/04 211/41.3
2,006,566 A 7/1935 Zimmer
2,264,238 A 11/1941 Burdwood
2,443,404 A * 6/1948 Tallarico ..... A47L 19/02 211/41.4
2,456,912 A 12/1948 Burrows
2,464,921 A 3/1949 Chandler
2,520,382 A 8/1950 Conrad et al.

(Continued)

FOREIGN PATENT DOCUMENTS

AU 2007200570 A1 5/2008
CA 2245807 8/1997

(Continued)

OTHER PUBLICATIONS

"One Source for Silicone Innovation", Dexas International, Ltd.; www.dexas.com; 1 page; 2006.

(Continued)

*Primary Examiner* — Stanton L Krycinski
(74) *Attorney, Agent, or Firm* — Lowe Graham Jones PLLC

(57) ABSTRACT

A collapsible dish drainer is formed using a resilient material allowing the dish drainer to collapse to a smaller size for storage. The dish drainer may be formed with one or more feet to raise the dish drainer above a countertop or other surface. A bottom or base of the dish drainer is configured to direct water toward a drain, with a pivotally mounted spout. An upper shelf is attached for lateral movement between an extended and retracted position.

15 Claims, 7 Drawing Sheets

(56) References Cited

U.S. PATENT DOCUMENTS

| | | | | | |
|---|---|---|---|---|---|
| 2,725,087 | A | | 11/1955 | Potter | |
| 2,732,696 | A | | 1/1956 | Baker | |
| 2,808,938 | A | | 10/1957 | Glover | |
| 2,936,898 | A | * | 5/1960 | Miguez | A47L 19/04 211/41.3 |
| 3,027,041 | A | * | 3/1962 | Stansbury, Jr. | A47L 19/04 211/41.3 |
| D199,320 | S | | 10/1964 | Seng | |
| 3,220,544 | A | | 11/1965 | Lovell | |
| 3,300,048 | A | | 1/1967 | Pollock | |
| 3,442,395 | A | * | 5/1969 | Taylor | A47L 19/04 211/41.3 |
| 3,889,837 | A | * | 6/1975 | Wilson | B65D 11/1833 220/62 |
| 4,001,904 | A | | 1/1977 | Gill | |
| D244,827 | S | | 6/1977 | Nevai | |
| 4,147,277 | A | | 4/1979 | Bateman et al. | |
| 4,220,534 | A | | 9/1980 | Perry | |
| D259,535 | S | | 6/1981 | Daenen | |
| 4,372,448 | A | * | 2/1983 | Drach | A47L 19/04 211/41.3 |
| 4,377,191 | A | * | 3/1983 | Yamaguchi | B65D 1/14 220/665 |
| 4,419,103 | A | | 12/1983 | Balkan | |
| D272,972 | S | | 3/1984 | De Coster | |
| 4,480,343 | A | * | 11/1984 | Drach | A47L 19/00 108/13 |
| D286,490 | S | | 11/1986 | Carlson | |
| 4,622,146 | A | | 11/1986 | O'Brien | |
| 4,873,100 | A | | 10/1989 | Dirksing et al. | |
| 5,035,800 | A | | 7/1991 | Kopach | |
| 5,226,551 | A | | 7/1993 | Robbins, III | |
| D346,725 | S | | 5/1994 | Kolada | |
| 5,384,173 | A | | 1/1995 | Akao et al. | |
| 5,392,941 | A | | 2/1995 | Robbins, III | |
| 5,417,337 | A | | 5/1995 | Robbins, III | |
| D359,202 | S | | 6/1995 | Cousins et al. | |
| 5,439,128 | A | | 8/1995 | Fishman | |
| 5,533,638 | A | | 7/1996 | Robbins, III | |
| 5,549,213 | A | | 8/1996 | Robbins, III et al. | |
| 5,575,398 | A | | 11/1996 | Robbins, III | |
| 5,584,413 | A | | 12/1996 | Jung | |
| 5,632,406 | A | | 5/1997 | Robbins, III | |
| 5,860,556 | A | | 1/1999 | Robbins, III | |
| 5,900,293 | A | | 5/1999 | Zettle | |
| 5,911,338 | A | | 6/1999 | Miller | |
| 5,913,448 | A | | 6/1999 | Mann et al. | |
| 6,035,766 | A | | 3/2000 | Schirmer | |
| 6,103,116 | A | | 8/2000 | Koslow et al. | |
| D433,884 | S | | 11/2000 | Fujimoto | |
| 6,158,620 | A | | 12/2000 | Polan | |
| 6,202,542 | B1 | | 3/2001 | Melton | |
| 6,315,151 | B1 | | 11/2001 | Hupp et al. | |
| 6,364,152 | B1 | | 4/2002 | Poslinski et al. | |
| 6,367,409 | B1 | | 4/2002 | Broom | |
| D469,667 | S | | 2/2003 | Burton | |
| 6,547,080 | B1 | | 4/2003 | Guard | |
| 6,736,285 | B2 | | 5/2004 | Stewart-Stand | |
| 6,758,348 | B2 | | 7/2004 | Adkins | |
| 6,811,051 | B2 | | 11/2004 | Higuchi | |
| D502,847 | S | | 3/2005 | Leonori | |
| D503,313 | S | | 3/2005 | Shamoon | |
| 6,949,190 | B2 | | 9/2005 | Hutzler | |
| D514,764 | S | | 2/2006 | Kumagai | |
| D522,809 | S | | 6/2006 | Kusuma et al. | |
| D534,701 | S | * | 1/2007 | Schmidt | D32/55 |
| D545,137 | S | | 6/2007 | Furlong et al. | |
| D555,310 | S | * | 11/2007 | Yang | D32/55 |
| D555,311 | S | * | 11/2007 | Yang | D32/55 |
| 7,325,694 | B2 | | 2/2008 | Bushey | |
| 7,325,695 | B2 | * | 2/2008 | Yang | A47L 19/04 211/41.2 |
| D586,061 | S | * | 2/2009 | Curtin | D32/55 |
| D599,069 | S | * | 8/2009 | Curtin | D32/55 |
| 7,678,271 | B2 | * | 3/2010 | Curtin | A47J 43/24 141/337 |
| 7,748,543 | B2 | * | 7/2010 | Yang | A47L 19/04 211/41.3 |
| D624,721 | S | * | 9/2010 | Curtin | D32/55 |
| 7,857,147 | B2 | * | 12/2010 | Mulaw | A47L 19/04 211/41.1 |
| D646,450 | S | * | 10/2011 | Yang | D32/55 |
| 8,074,813 | B2 | * | 12/2011 | Yang | A47L 19/04 211/41.3 |
| D651,779 | S | * | 1/2012 | Balkum | D32/55 |
| D669,318 | S | | 10/2012 | Bagley | |
| D692,200 | S | * | 10/2013 | Lee | D32/55 |
| D714,508 | S | * | 9/2014 | Joy | D32/55 |
| 8,871,092 | B2 | * | 10/2014 | Curtin | A47J 43/22 141/337 |
| 8,925,743 | B1 | * | 1/2015 | Lee et al. | A47L 19/04 211/41.6 |
| 2003/0217649 | A1 | | 11/2003 | Leonori | |
| 2005/0127073 | A1 | | 6/2005 | Kusuma et al. | |
| 2005/0127074 | A1 | * | 6/2005 | Kusuma | B65D 21/086 220/6 |
| 2006/0096929 | A1 | * | 5/2006 | Repp | A47J 19/00 210/740 |
| 2007/0090063 | A1 | * | 4/2007 | Schmidt | A47L 19/04 211/41.3 |
| 2007/0181489 | A1 | | 8/2007 | Lee | |
| 2007/0251874 | A1 | * | 11/2007 | Stewart | A47J 43/24 210/232 |
| 2009/0211994 | A1 | * | 8/2009 | Yang | A47L 19/04 211/41.4 |
| 2010/0059460 | A1 | * | 3/2010 | Mulaw | A47L 19/04 211/41.3 |
| 2014/0061193 | A1 | * | 3/2014 | Sudakoff | B65D 21/086 220/200 |
| 2014/0246445 | A1 | * | 9/2014 | Lee | A47L 19/04 220/666 |
| 2015/0251808 | A1 | * | 9/2015 | Tsui | A45F 3/20 220/8 |

FOREIGN PATENT DOCUMENTS

| | | | |
|---|---|---|---|
| CA | 2245807 | | 12/2005 |
| CA | 2602047 | | 9/2008 |
| CA | 2602253 | | 12/2008 |
| CN | 201119807 | | 9/2008 |
| CN | 201160796 | | 12/2008 |
| CN | 201167889 | | 12/2008 |
| EP | 719708 | | 7/1996 |
| EP | 0719708 | A1 | 7/1996 |
| EP | 1764017 | A1 | 3/2007 |
| EP | 1917890 | | 5/2008 |
| EP | 1917890 | A1 | 5/2008 |
| GB | 2028675 | | 3/1980 |
| JP | 09-192031 | | 7/1997 |
| WO | 2006054168 | | 5/2006 |
| WO | 2009023892 | | 2/2009 |
| WO | 2009023892 | A1 | 2/2009 |

OTHER PUBLICATIONS

"Strainer". Good Design 2005, Norman Copenhagen, http://www.norman-copenhagen.com/the1.html, 1 page, Printed Jul. 13, 2006.

"Prepology Set of 3 Silicone Collapsible Colanders," QVC, http://www.qvc.com/scripts/detail.dll, 5 pages, Printed Jul. 5, 2006.

"The Norman Collapsible Colander," Smart Stuff, www.smartsuff.se; 2 pages, Aug. 2005.

"The Norman Collapsible Colander," Smart Stuff, www.smartstuff.se; 2 pages, Aug. 2005.

* cited by examiner

COLLAPSIBLE DISH DRAINER

PRIORITY CLAIM

This application claims the benefit of provisional U.S. application Ser. No. 61/982,639, filed Apr. 22, 2014, the contents of which are hereby incorporated by reference.

FIELD OF THE INVENTION

This application relates to dish drainers and dish racks for holding wet dishes while drying.

BACKGROUND OF THE INVENTION

A dish drainer or dish drying rack is commonly used to hold dishes after they have been washed and rinsed so that they may be allowed to dry. In a household setting, a dish rack is frequently placed next to a sink and may include a lower mat or plate for collecting and directing dripping water back into the sink.

Conventional dish drainers suffer from several problems. One primary concern is that they are very large and bulky, making them very difficult to store when not in use. If left on a countertop, they take up a great deal of space. In addition, current dish drainers are configured to direct dripping water in a single direction. Commonly, dish drainers have a generally rectangular footprint and divert dripping water in a direction parallel to one of the sides. This configuration for the dish drainer limits the possible placement of the dish drainer on a countertop with respect to the location of the sink. Many users may elect not to use a dish drainer at all in view of these defects.

SUMMARY OF THE INVENTION

In accordance with one preferred version of the present invention, a dish drainer is formed using a resilient material allowing the dish drainer to collapse to a smaller size for storage. The dish drainer may be formed with one or more feet to raise the dish drainer above a countertop or other surface. A bottom or base of the dish drainer is configured to direct water toward a drain. A rigid or semi-rigid upper rim is provided, with the resilient material extending between the base and the rim.

One version of the invention further includes a configurable upper shelf that can slide inward or outward as desired to hold stemware or other objects.

Some versions of the invention may also include a drain hole formed in the base of the dish drainer, with a pivotable spout allowing drainage water to be directed in a variety of directions.

In some examples, the base includes several raised flanges that are spaced apart to receive the rim of a plate to facilitate spaced-apart, vertical orientation of plates positioned on the base.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
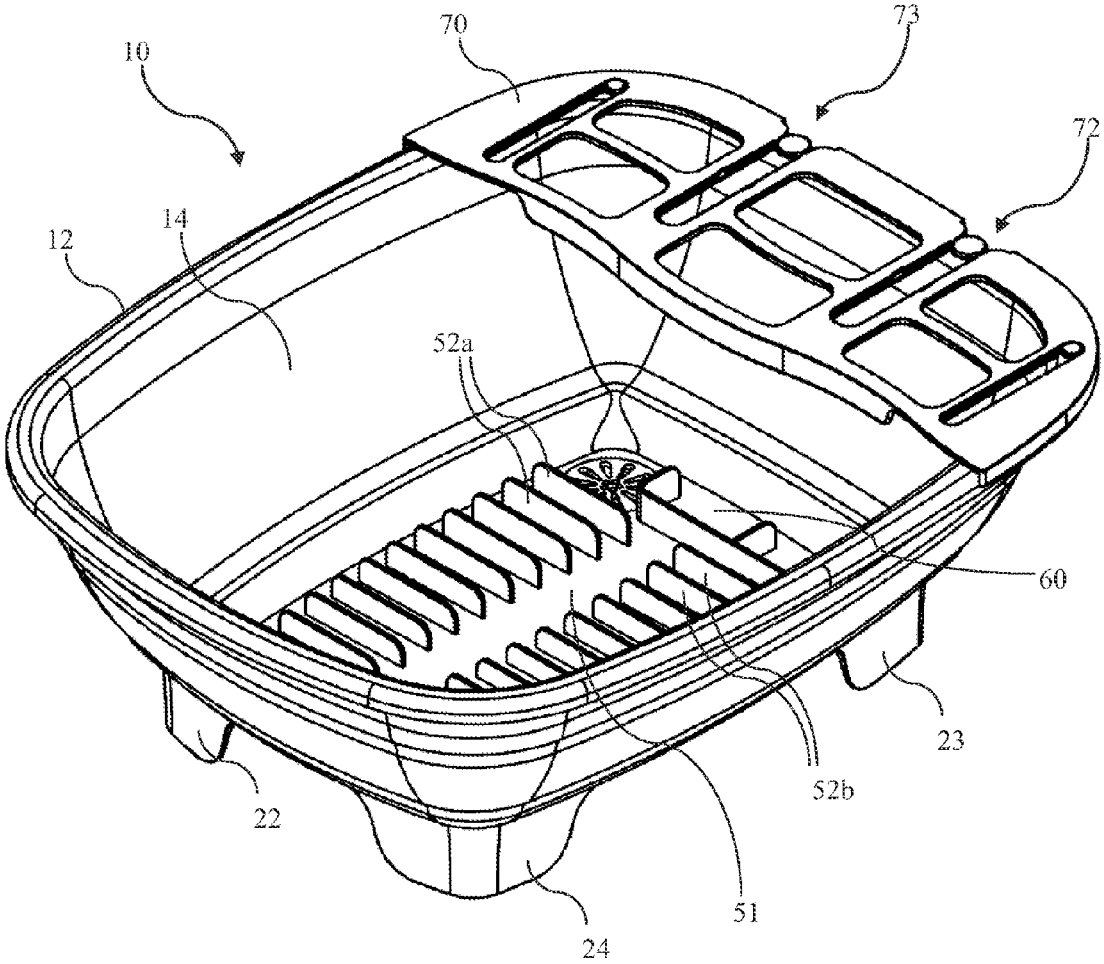
FIG. 1 is a top perspective view of a preferred collapsible dish drainer.

A preferred dish drainer 10 is illustrated in the accompanying figures. In one preferred version, the dish drainer includes a lower base having an upper side 50 and a lower side 51, an upper rim 12, and side-walls 14 extending upwardly from the lower base to the upper rim. In the illustrated version, the base and the rim are formed from materials that are relatively more rigid than the material used for the sidewalk. Most preferably, the sidewalls are formed from a silicone material while the rim is formed from a plastic material. In other versions, the entire dish strainer may be formed from a resilient material.

Figure 3:
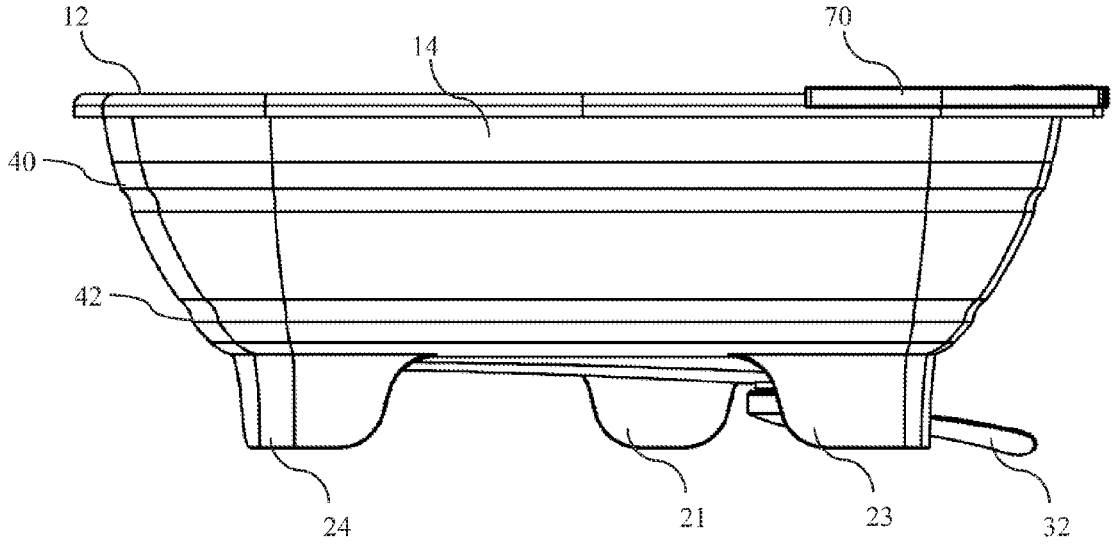
FIG. 3 is a side elevational view of a preferred collapsible dish drainer.

The sidewalls of the dish drainer preferably include an upper living hinge 40 and a lower living hinge 42, as best seen in FIG. 3. The upper and lower living hinges are positioned relatively adjacent the rim and the base, respectively, to allow the dish drainer to be folded into three sections for relatively compact storage. In other versions of the dish strainer may include additional living hinges if desired.

Figure 6:
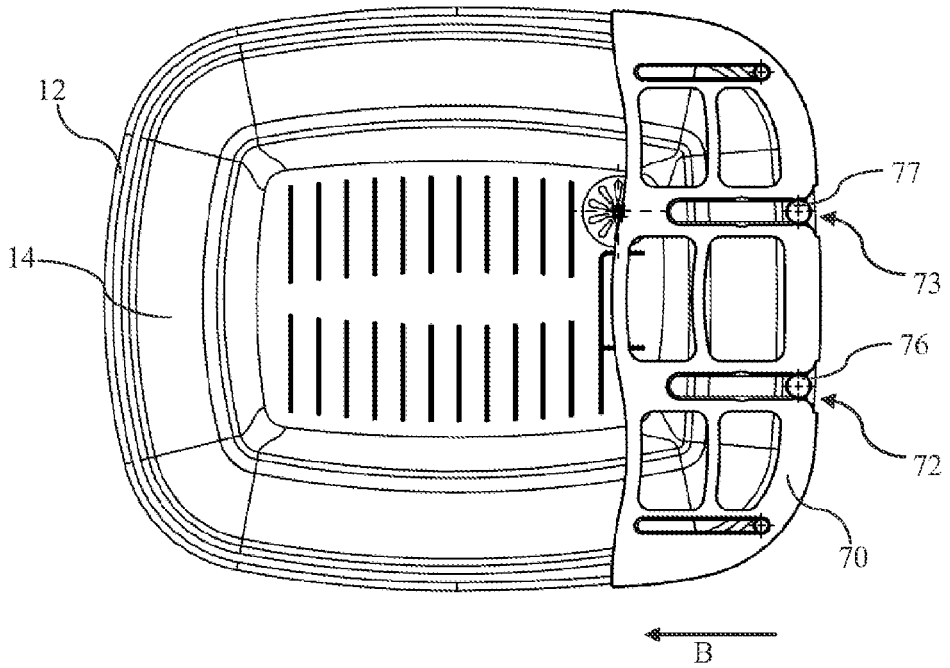
FIG. 6 is a top plan view of a preferred collapsible dish drainer, illustrated with an upper shelf in a retracted position.
Figure 7:
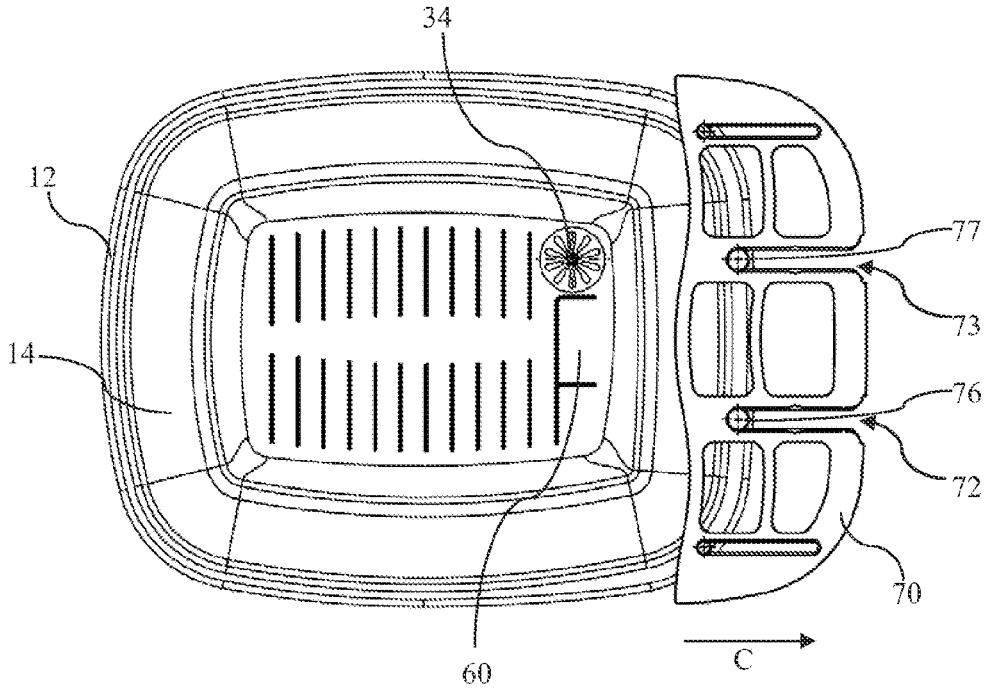
FIG. 7 is a top plan view of a preferred collapsible dish drainer, illustrated with an upper shelf in an expanded position.

In one version of the invention, the dish drainer includes a shelf 70, which in the illustrated version is configured to slide laterally outward from the rim and inward to a position substantially within an area bounded by the rim. In the top plan view of FIG. 6, the shelf 70 is shown in a retracted position in which it is moved laterally inward in the direction of arrow B, overlying the base of the dish drainer. In the top view of FIG. 7, the shelf 70 is shown in an extended position, moved laterally outward in the direction of arrow C so that it extends laterally beyond and outside the boundary formed by the rim 12 of the dish drainer.

Figure 4:
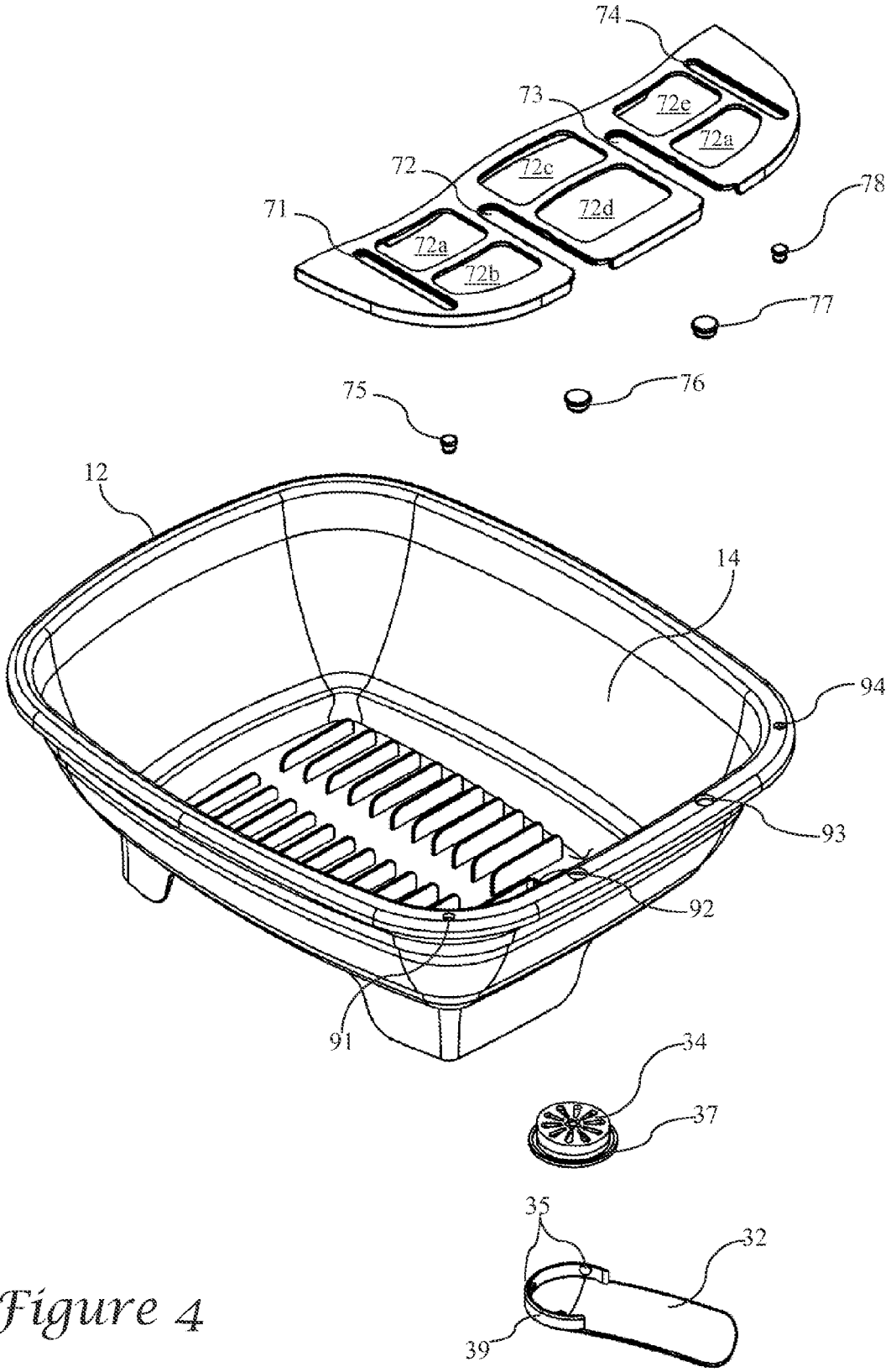
FIG. 4 is a top perspective exploded view of a preferred collapsible dish drainer.

In one example, the rim includes four holes 91-94, best seen in FIG. 4, which are configured to receive four retaining lugs 75-78. In other versions, the retaining lugs may be integrally formed with the rim or may be otherwise secured to the upper rim. The shelf 70 is formed with four slots 71-74, with each of the four slots being positioned to slidably receive a separate one of the four lugs. In the illustrated version, two of the four slots (particularly, the two centrally located slots) are formed to be open-ended such that the slots extend all the way to and through the outer perimeter of the shelf. The other two slots are formed such that they are bounded around the entire perimeter by the shelf.

The retaining lugs are each formed with an upper terminal end which is wider than a lower neck of the lug, with the corresponding slots formed in the shelf being sized such that the slots are smaller in width than the upper terminal end of the corresponding lug. Accordingly, the shelf may slide laterally back and forth along a path defined by the slots, while the shelf is retained against the upper rim 12 by the wider terminal end of the lugs. Each of the four slots is also formed to be parallel to one another, thereby defining a substantially linear path of travel of the shelf with respect to the dish drainer.

Figure 5:
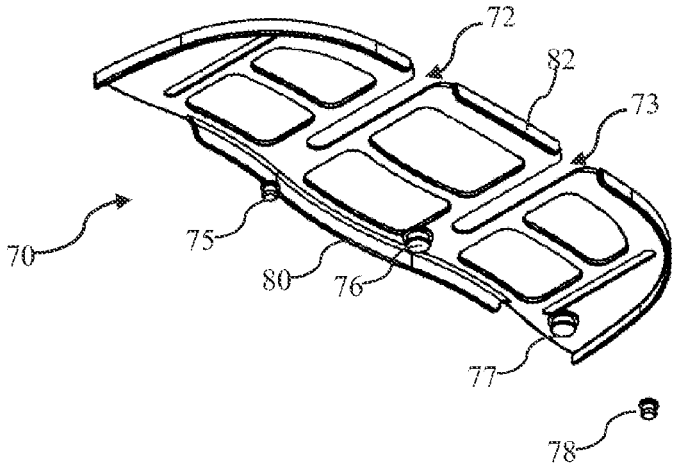
FIG. 5 is a bottom perspective exploded view of a preferred collapsible dish drainer.
Figure 5:
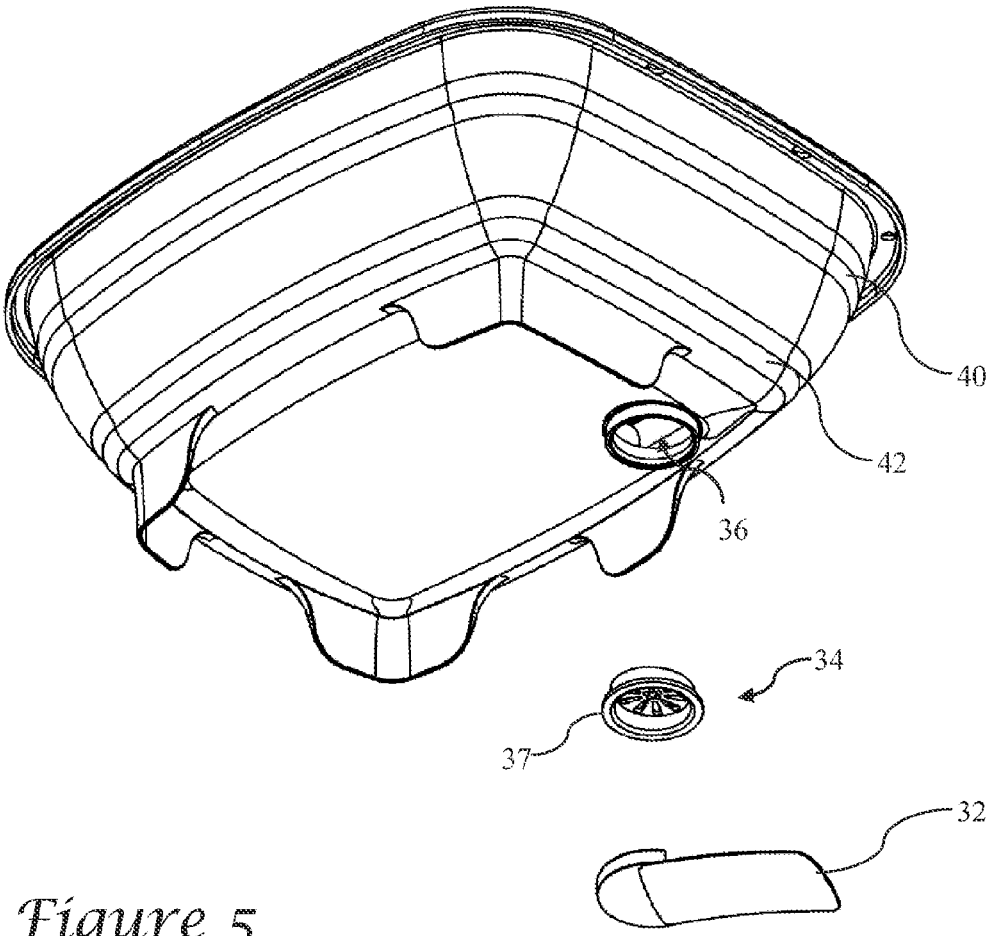

The shelf 70 preferably further includes a peripheral downwardly depending flange, such as best seen in the bottom perspective view of FIG. 5, to help prevent the shelf from traveling outwardly beyond the rim 12 of the dish drainer or inwardly beyond the edge of the rim. In the illustrated version, the flange includes an inner flange portion 80 formed along an interior edge of the shelf and an outer flange 82 formed along an exterior edge of the shelf. In some versions, the downwardly depending flange may also extend along the sides and corners of the shelf, as shown. The flanges 80, 82 combine to define limits to the path of lateral travel of the shelf 70 in both directions. Thus, the inner flange 80 abuts the rim 12 at the extended location while the outer flange 82 abuts the rim 12 at the retracted location of the shelf.

The shelf is preferably formed with a plurality of openings 72*a*-72*f*, as best seen in FIG. 4, with the openings formed in the shelf being positioned to allow cutlery or other elongated items to be positioned within the openings for drying. In one version, six separate openings are provided, with two openings being positioned between the two central slots 72, 73, and two additional openings positioned on each of the two outer sides of the two central slots. Thus, the six openings are formed as three pairs of openings with a structural cross member separating each of the pairs.

The upper side of the base 51 is preferably formed with a plurality of features to allow dishes be positioned on end for drying. In the illustrated version, the base includes a plurality of upwardly extending ribs 52*a*, 52*b* (see FIG. 1) evenly spaced apart from one another and configured to allow an edge of the plates to be received within the space between adjacent ribs. Most preferably, the ribs are formed as two rows of ribs positioned adjacent to and parallel to one another.

A flatware retaining box 60 is also preferably formed on the upper side of the base 51. In the illustrated version, the flatware retaining box is configured as an upwardly extending flange formed as an "F" shape in the floor of the dish drainer. The flatware retaining box is positioned in one corner of the base of the dish drainer, beneath four of the openings in the shelf, and is positioned such that the flanges close to but spaced apart from the upwardly extending outer edges of the dish drainer. This separation allows water to flow out of the flatware box rather than being trapped within it.

The base of the dish drainer further includes a drain hole 36 (see FIG. 5), which in the illustrated version is positioned in a corner of the base adjacent the flatware box. Preferably, the drain hole includes a drain grate 34 having a plurality of openings and being configured to block large solid items from passing through the drain hole.

In the illustrated version, the drain grate 34 is formed as a short upright cylinder (best seen in FIG. 5) and the drain hole 36 is configured as a circular opening in the base of the dish drainer. The drain hole further includes a short downwardly extending annular flange about the perimeter of the drain hole, sized and shaped to receive the cylindrical drain grate. The drain grate further includes a laterally extending annular shelf 37 formed about a lower perimeter of the drain grate. In other versions, the drain hole and drain grate may be formed as a single unitary component. Likewise, in other versions the drain grate may be inserted into an upper side of the base rather than being inserted upwardly from the lower side of the base as illustrated.

A drain spout 32 is pivotally attached to the drain hole, and in accordance with the illustrated preferred embodiment the drain spout attaches to the lateral shelf 37 of the drain grate 34. The drain spout is formed with an elongated concave shape, allowing water to be directed within the shallow channel formed by the concave shape. In the preferred version as illustrated, the drain spout is open-topped. At one end of the drain spout (that is, the end attached to the drain grate), a short vertical sidewall 39 is formed. Preferably, the sidewall extends around a region at least somewhat greater than a semi-circle when viewed from the top, forming an approximate "C" shape. The vertical sidewall is sized and configured to receive the laterally extending annular shelf formed in the drain grate. An upper inward-directed abutment, preferably formed as a plurality of stems 35, trap the drain grate within the vertical sidewall for pivotal movement of the spout with respect to the drain grate.

In one version, the spout is removable from the dish drainer to allow it to be cleaned and thoroughly dried between uses. In such an example, as described above, the spout can be snap-fit onto the grate. Likewise, in one version the drain grate is removably attached to the base of the dish drainer.

The base of the dish drainer is formed with one or more feet configured to allow the dish drainer to rest on a horizontal surface. In addition, the feet are preferably configured to create vertical space between the bottom edge of the feet and the lower surface of the base 50, thereby allowing room for the spout to be positioned. In the same vertical space above a counter top and below the base of the dish drainer. In the illustrated version, several feet 21-24 are provided.

Figure 2:
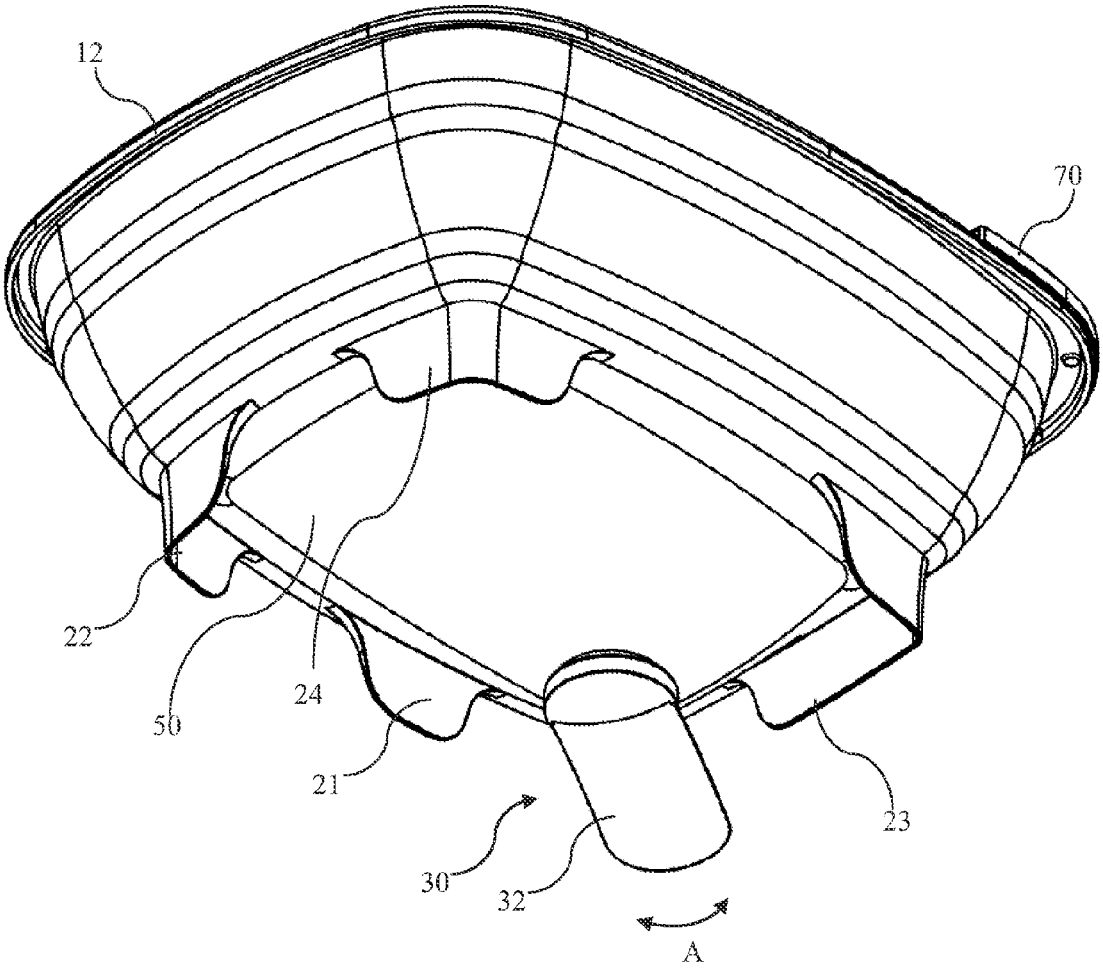
FIG. 2 is a bottom perspective view of a preferred collapsible dish drainer.

In the version as illustrated, in which the spout is positioned at one corner of the substantially rectangular or oblong dish drainer base, one foot 21 is positioned along one side of the dish drainer and another foot 22 is positioned along a perpendicular side of the dish strainer. An opening 30 is thereby created at a bottom corner of the dish drainer, allowing pivotal movement of the spout as indicated by arrow A in FIG. 2 within the opening defined between feet 21 and 23.

Figure 8:
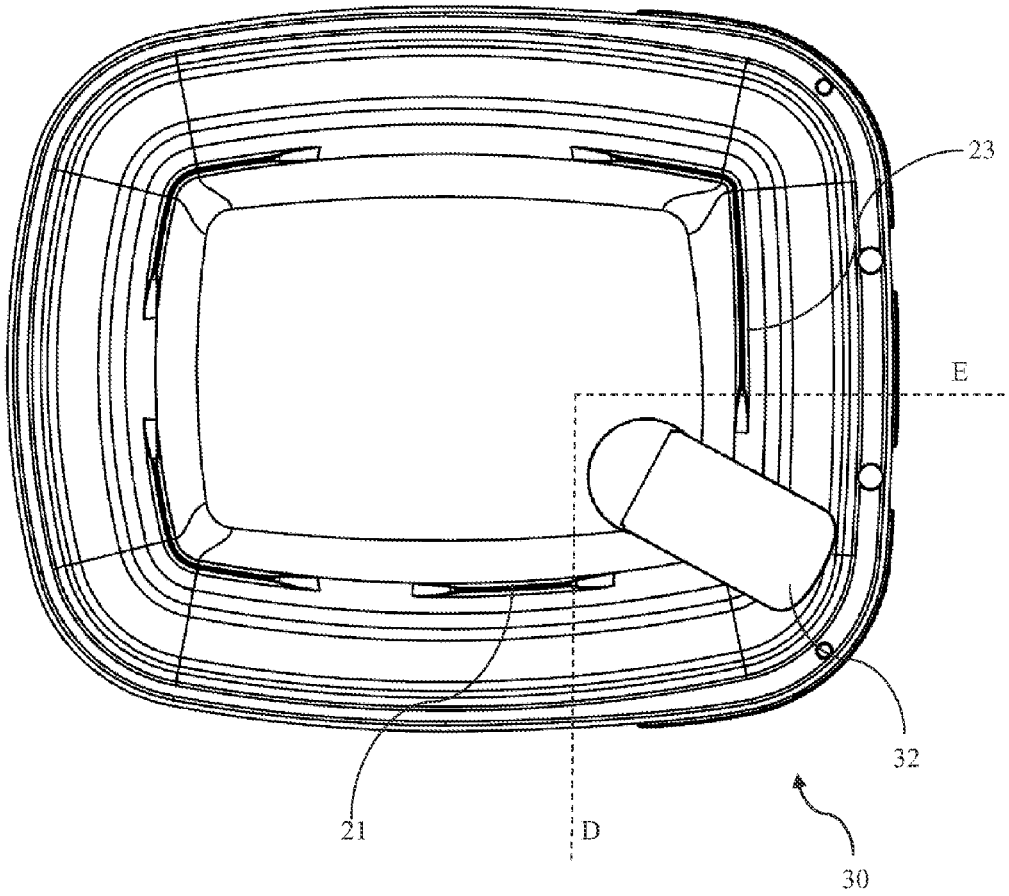
FIG. 8 is a bottom plan view of a preferred collapsible dish drainer.

Most preferably, the opening 30 is sized and spaced to allow pivotal movement of the spout along an arc of greater than 90° (see FIG. 8) to allow rotation of the spout and a wide range of optional positions of the dish drainer with respect to an adjacent sink. Thus, the opening 30 is defined by the space between edges of feet 21 and 23 closest to the spout 32. A tangent line to a first foot 21 is defined by line D in FIG. 8, while a tangent line to a second foot 23 is defined by line E. The lines intersect to define an angle of about 90 degrees. The drain hole is positioned to allow the spout to be attached in the vicinity of the intersection of lines D and F, and most preferably at a location that enables pivotal movement of the spout within the 90 degrees defined by lines D and E. Accordingly, pivotal movement of the spout allows it to move between a first position adjacent the first foot 21 and a second position adjacent the second foot 23, in which the first position is approximately 90 degrees rotated from the second position. As illustrated, the spout 32 occupies a third position, mid-way between the first and second positions.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follow:

1. A dish drainer, comprising:

a base having a lower side and an upper side;

a rim;

a flexible membrane extending between the base and the rim, the flexible membrane having a plurality of living hinges to enable the dish drainer to be configured in either a collapsed position or an expanded position;

a drain hole formed in the base;

a spout pivotally attached to the drain hole at the lower side of the base, the spout being configured to direct water from the drain hole away from the dish drainer; and a drain grate positioned in the drain hole, the drain grate having a lateral shelf and the spout having a vertical sidewall, the shelf of the drain grate engaging the sidewall of the spout to connect the spout to the drain grate and allow pivotal movement of the spout with respect to the drain grate.

2. The dish drainer of claim 1, wherein the spout is attached for pivotal movement along an arc of 90 degrees.

3. The dish drainer of claim 1, further comprising one or more feet positioned on the lower side of the base, the feet defining an opening in which the spout and drain hole are positioned within the opening, the opening further forming edges that limit the pivotal path of travel of the spout.

4. The dish drainer of claim 3, further comprising a plurality of upwardly extending ribs formed on the upper surface of the base.

5. The dish drainer of claim 4, further comprising an upper shelf carried on the rim, the upper shelf being attached to the rim for lateral movement between a retracted position in which the upper shelf is positioned within the boundary formed by the rim, and an extended position in which the upper shelf is positioned laterally beyond the boundary of the rim.

6. The dish drainer of claim 5, wherein the rim comprises a plurality of lugs and the upper shelf comprises a plurality of slots, the plurality of lugs being positioned in the plurality of slots to retain the shelf against the rim and define a lateral path of travel of the upper shelf.

7. The dish drainer of claim 6, wherein the upper shelf further comprises a downwardly extending flange, the flange serving as a stop to limit the lateral travel of the upper shelf.

8. A dish drainer, comprising:

a base having a lower side and an upper side, the base further having a shape selected from one of oblong or rectangular, the base having one or more feet extending below the lower side;

a rim;

a flexible membrane extending between the base and the rim, the flexible membrane being configured to enable the dish drainer to be positioned in either a collapsed position or an expanded position;

a drain hole positioned in the base and located at one corner of the base; and a spout movably attached to the drain hole and positioned on the lower side of the base, the spout being configured to direct water from the drain hole away from the dish drainer;

wherein the feet further comprise a first foot and a second foot which terminate in edges that define an opening between the first foot and the second foot and in which the spout is positioned within the opening, the edges of the first foot and the second foot defining a limit to a pivotal path of travel of the spout.

9. The dish drainer of claim 8, further comprising a drain grate positioned in the drain hole.

10. The dish drainer of claim 9, wherein the drain grate is removably attached to the base.

11. The dish drainer of claim 10, wherein the spout is pivotally attached to the drain grate.

12. The dish drainer of claim 11, further comprising a plurality of upwardly extending ribs formed on the upper surface of the base.

13. The dish drainer of claim 8, further comprising an upper shelf carried on the rim, the upper shelf being positioned for lateral movement between a retracted position in which the upper shelf is positioned within the boundary formed by the rim, and an extended position in which the upper shelf is positioned laterally beyond the boundary of the rim.

14. The dish drainer of claim 13, wherein the rim comprises a plurality of lugs and the upper shelf comprises a plurality of slots, the plurality of lugs being positioned in the plurality of slots to retain the shelf against the rim and define a lateral path of travel of the upper shelf.

15. The dish drainer of claim 14, wherein the upper shelf further comprises a downwardly extending flange, the flange serving as a stop to limit the lateral travel of the upper shelf.

* * * * *